United States Patent [19]

Leliaert

[11] 3,945,155

[45] Mar. 23, 1976

[54] METHOD OF REMOVING ICE FROM A SURFACE BY BLASTING

[75] Inventor: Raymond M. Leliaert, South Bend, Ind.

[73] Assignee: Wheelabrator-Frye, Inc., Mishawaka, Ind.

[22] Filed: Jan. 14, 1974

[21] Appl. No.: 433,067

[52] U.S. Cl. ..... 51/319; 134/7

[51] Int. Cl.[2] ..... B24C 1/00

[58] Field of Search ..... 51/8 R, 9 R, 319, 320, 51/321, 9 M, 9; 15/340, 345–346; 299/17, 18; 134/7, 37

[56] References Cited

UNITED STATES PATENTS

| | | | |
|---|---|---|---|
| 2,064,344 | 12/1966 | Good | 15/345 X |
| 2,684,558 | 7/1954 | Harris | 51/8 R |
| 2,789,804 | 4/1957 | Toulmin | 134/7 |
| 3,007,191 | 11/1961 | Braun | 15/340 |
| 3,034,262 | 5/1962 | Pawlson | 51/9 M |
| 3,075,319 | 1/1963 | Blubaugh | 51/8 R |
| 3,380,196 | 4/1968 | Mabille | 51/9 M |
| 3,691,689 | 9/1972 | Goff | 51/9 M |

*Primary Examiner*—Al Lawrence Smith
*Assistant Examiner*—Nicholas P. Godici
*Attorney, Agent, or Firm*—McDougall, Hersh & Scott

[57] ABSTRACT

A method for treatment of a surface over which vehicles travel with particulate material is disclosed. Particulate material is projected onto the surface with kinetic energy exceeding the bonding energy of the surface or the bonding energy of a deposit adhering to the surface which it is desired to remove. In the former case the method effects texturing of the vehicular surface by pitting thereof. In the latter case the method effects cleaning of the surface by removing the bonded deposits therefrom. Additionally, the method can be used for preparing a surface for repaving or for removing ice therefrom.

6 Claims, 11 Drawing Figures

METHOD OF REMOVING ICE FROM A SURFACE BY BLASTING

BACKGROUND OF THE INVENTION

This invention relates to the field of surface treatment. Specifically, it relates to surface treatment of airport runways and taxi surfaces, automobile highways, auto racetracks and other surfaces over which vehicles travel which require either initial or periodic surface treatment.

Vehicular surfaces, such as runways and highways, are usually composed of asphalt, concrete or similar type bonded paving materials. Depending upon the application for which the surface is used, certain surface requirements are necessary. For example, a runway surface used for landing and takeoff of airplanes, must have a minimum coefficient of friction in order to permit safe takeoff and landings. The coefficient of friction may be increased by texturing, grooving or otherwise roughening the surface to yield the necessary frictional coefficient. After heavy use, a layer of deposits including rubber scuff marks from tires, petroleum residues and the like build up on the surface reducing the coefficient of friction when the surface is wet. The combination of rubber, petroleum deposits and water promotes hydroplaning of aircraft during takeoff and landing making such operations excessively hazardous.

A related problem is texturing a new surface or a cleaned surface to generate a desired coefficient of friction. It is also desirable to texture a surface prior to repaving or patching it in order to increase the bonding strength between the old surface and the new. Prior methods included texturing a runway when paving utilizing a broom, grooving the surface transversely, or adjusting the paving composition to provide for a high content of aggregate particles at the surface of the pavement. While these texturing techniques can provide initial surface roughness, sacrifices are necessary in terms of ultimate strength of the surface, and further, with the exception of grooving they cannot be used to restore texture to a cleaned surface.

In connection with vehicular surfaces where ice has formed thereon, it is necessary to remove the ice to restore as nearly as possible the dry characteristics of the surface. This is a particular problem in regard to airplane runways since aircraft construction prohibits the use of corrosive deicing chemicals such as sodium or calcium salts. Present techniques include the use of urea, alcohol, glycol mixtures or other noncorrosive eutectics to prevent ice formation. The high cost of these materials and the detrimental effect on the environment constitute drawbacks which suggest the need for alternate ice removal techniques.

In regard to all the areas of surface treatment outlined above, it has been found that the existing methods and devices for accomplishing the desired results have not been satisfactory and, in particular, prior methods of cleaning rubber scuff marks and petroleum deposits from an airport runway and adjacent surfaces have been limited to such methods as chemical treatment, scraping, hydraulic pressure treatment, or cutting the deposits. Alternately the deposits have been grooved transversely to the direction of travel by means of a high speed rotating abrasive wheel to restore frictional contact. This technique is expensive and becomes less effective as the deposits get heavier.

It is accordingly an object of the present invention to provide a method for cleaning rubber, carbon, petroleum residues and like deposits from a vehicular surface to restore its capability for safely handling traffic.

It is a further object of the present invention to provide a method of cleaning a vehicular surface by projecting a particulate material onto the surface with a kinetic energy exceeding the bonding energy between any deposits on the surface and the surface itself.

It is a further object of the present invention to provide a method for cleaning a vehicular surface with particulate material whereby the material is recovered after cleaning for reuse.

It is a further object of the present invention to provide a process for texturing a surface with particulate material to increase the frictional engagement of the surface with vehicles traveling thereon.

It is yet another object of the present invention to texture a vehicular surface by projecting particulate material onto a surface at a velocity sufficient to provide the material with kinetic energy greater than the bonding energy of the surface composition.

It is another object of the present invention to prepare a damaged surface for patching or for resurfacing by particulate blast to roughen the surface to be repaired, thereby to increase the bonding strength between the existing surface and the new surface.

It is another object of the present invention to provide a method for removing sheets or patches of ice from vehicular surfaces by means of a particulate blast to fragment the ice particles for subsequent removal by conventional equipment.

It is a still further object of the present invention to provide a method for fragmenting ice particles on a vehicular surface by projecting particulate material onto the ice with sufficient kinetic or impact energy to fragment the ice for subsequent removal.

These and other objects of the present invention will become apparent from the concluding portion of the specification.

The method disclosed relates to surface treatment. Some existing particulate blast devices can, with modifications, perform the method disclosed herein. For example, in U.S. Pat. No. 3,691,689 to Goff, description is made of a mobile apparatus for cleaning surfaces with a particulate material. In this apparatus the particles are thrown centrifugally at high velocity downwardly onto the surface to be treated. After treatment the particulate material is recovered by means of a brush. Other devices for picking up the spent particulate include magnetic means as described in my copending patent application Ser. No. 432,353, now U.S. Pat. No. 3,858,359, vacuum means as described in a copending application Ser. No. 363,723 assigned to the assignee of the present application, and various other means as described in the following: U.S. Pat. No. 3,034,262 to Paulson, U.S. Pat. No. 3,380,196 to Mabille, and U.S. Pat. No. 3,448,544 to Cardon. While some or all of these prior devices can be adapted to perform the method of the present invention, none of them teaches or discloses the requisite steps for attaining the results desired according to the present invention.

CLEANING VEHICULAR SURFACES

Automobile highway, airplane runways and taxi surfaces and similar vehicular surfaces are subject to skid and scuff marks from rubber tires as well as deposits of hydrocarbon-based residue from the engine systems of the vehicles using these surfaces. Referring specifically to airplane runways, such surfaces are particularly subject to the action of rubber scuff marks due to the aircraft tires impacting on the surface during landing. Due to the inertia of the tire and wheels, scuffing and skidding occurs when the wheels, initially at rest, strike the pavement and are rapidly brought up to the landing velocity of the aircraft and then braked to a stop. Such normal skidding and braking action causes the transfer of rubber from the tire treads to the surface of the concrete, asphalt or other composition runway, with some decomposition taking place due to the frictional heat that is developed. Deposits of carbon, fuel, lubricating oil and the like are also found in these same areas as a result of engine blast and leakage from aircraft during landing and takeoff. Similarly aircraft support vehicle traffic leaves additional rubber and petroleum type deposits.

The deposits may build up to as much as 1/4 inch and the surface loses its original friction characteristics necessary for safe operation. Specifically, the rubber and petroleum deposits have been found to promote hydroplaning of the rubber-tired wheels of aircraft during landing and subsequent braking when the surface is wet from rain or melting snow. Removal of these deposits can restore and even improve the integrity of the runway surface for safe operation.

Present methods of deposit removal employ chemical acids with a view towards solution and/or breakdown of the organic components making up the layer bonded to the surface or use high pressure water sprays. In addition, wire brushes, abrasive grinding wheels and hammer mill knives have been employed to seek removal of these deposits. These techniques, while somewhat successful, have the common drawback of polluting the water runoff with chemicals and removed rubber and petroleum deposits. This can kill grass and other vegetation in the vicinity, causing excessive dust from engine exhaust.

Figure 1:
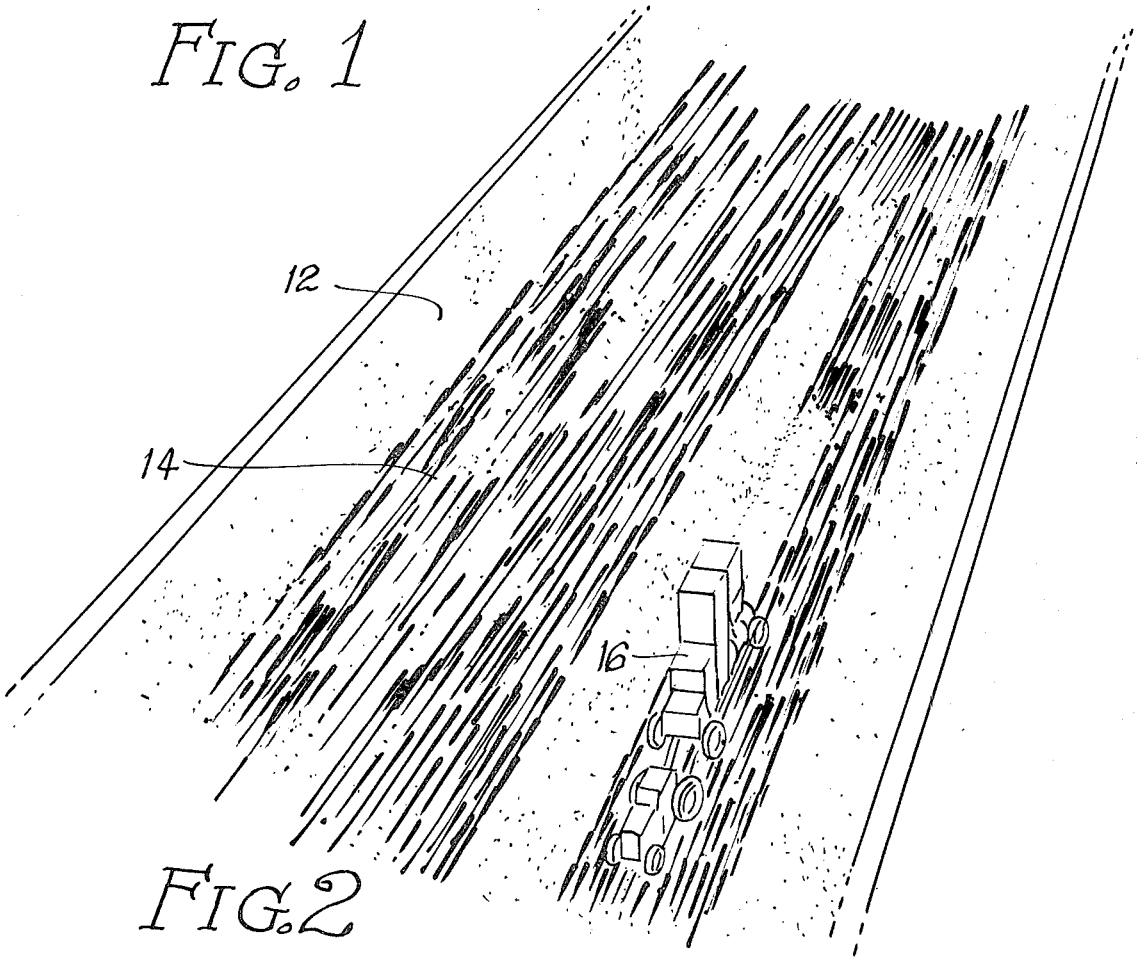
FIG. 1 is a perspective view of an airport runway indicating the location and nature of deposits which accumulate on the runway surface.

Referring to FIG. 1, there is illustrated a typical aircraft runway 12 showing a portion of the runway coated with rubber and petroleum-based deposits 14. Typically, such heavy deposits occur only at the ends of a runway where the aircraft take off and land.

Figure 2:
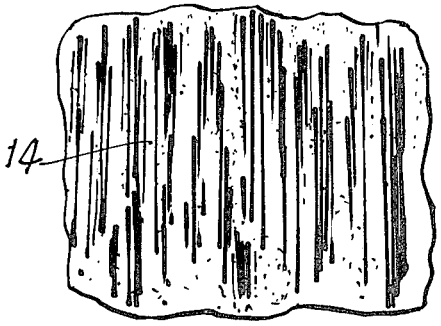
FIG. 2 is a top view of a runway surface having a deposit thereon.
Figure 3:
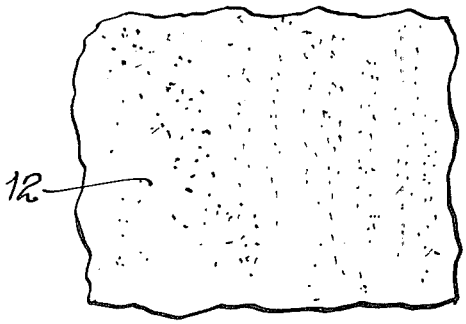
FIG. 3 is a view of the runway surface of FIG. 2 having the deposit removed therefrom.

Referring now to FIG. 2, it will be seen that the objectionable deposits 14 form an irregular layer over the paved surface of the runway. The rubber and petroleum deposits become bonded to the surface during frictional engagement between the tires and the surface. For example, when the tires of a landing gear strike the surface, the rubber which is scuffed off is securely bonded to the surface by the heat and pressure of the scuffing process. In the case of petroleum-based deposits, this material is often spilled onto the runway surface and permitted to remain indefinitely, subjecting it to weathering conditions which tend to cause it to bond to the runway surface.

According to the present invention it has been found that these objectionable deposits can be removed from a vehicular surface, whether it be a highway surface covered with hydrocarbon deposits or an aircraft surface covered with hydrocarbon and rubber deposit from aircraft landings. The present method utilizes particulate material projected onto the surface to be cleaned. The particulate material can be of any of the types currently known and includes abrasives such as sand, cinders, grit and the like, although steel shot and steel grit are preferred. The physical characteristics of the particulate material to be utilized are chosen based on the type of surface to be treated and the performance parameters of whatever means are employed to project it onto the surface.

For the type of equipment 16 illustrated in FIGS. 1 and 5, to be discussed hereinafter, steel shot on the order of 0.007 to 0.078 inches is preferred. Alternatively, if steel grit is used, it is preferred to use on the order of No. 7 mesh to No. 200 mesh. The smallest shot or grit that will successfully perform the method should normally be used since this increases the number of particle impacts per unit of surface area, thereby maximizing the efficacy of the operation. For example, steel shot of 0.046 inch diameter will yield only 55,000 impacts per pound of shot while shot of 0.023 inch diameter yields 420,000 impacts per pound. Of course larger or smaller size grit or shot can be employed for different purposes as will be explained hereafter.

The key factor in successfully removing deposits from a vehicular surface with particulate material is recognizing that the kinetic energy or impact force with which the material is projected onto the surface must be greater than the bonding energy between the deposit to be removed and the surface to be cleaned. That is, particulate projected onto the surface must be energetic enough to penetrate the deposit and overcome the bonding energy between the surface and the deposit to be removed. The kinetic energy of projected abrasive is given by $$K.E. = C \times F_r \times V^2$$

where $C$ is a gravitational constant;

$F_r$ is the flow rate of abrasive material to the means projecting the abrasive onto the surface;

$V$ is the velocity of the projected abrasive.

For example, kinetic energy or impact force for a typical cleaning operation, assuming a flow rate of 6.5 lbs. of steel shot per second and a projecting velocity of 300 feet per second is calculated as $$K.E. = \frac{1}{2} \frac{6.5 \frac{\text{lbs.}}{\text{sec.}} \times 300 \frac{\text{ft.}}{\text{sec.}}^2}{(32.2 \text{ ft./sec.}^2)}$$

or $K.E. = 9.084 \times 10^3$ ft.lbs./sec.

Figure 4:
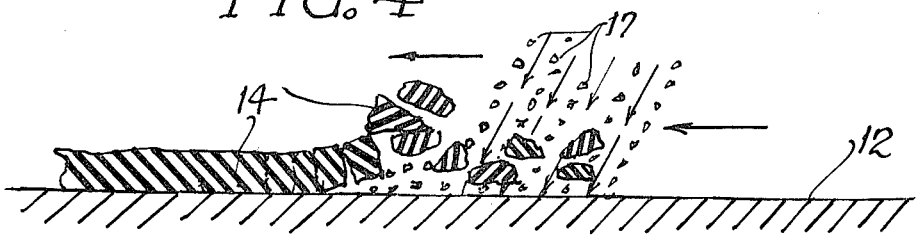
FIG. 4 is a cross-sectional view illustrating the method used to remove deposits.

As shown in FIG. 4, when particulate material 17 is projected onto a surface at kinetic energies greater than the bonding energy of the deposits 14, the particles penetrate the deposits and disrupt the bond between the surface and the deposits permitting subsequent removal.

Ideally, the method of the present invention should be practiced with a portable device capable of traveling along a surface to be treated and which recovers the spent material and picks up the removed deposits. If the apparatus employing the present invention has the further capability of separating the particulate material from the deposits recovered, the material can be recycled and reused so that a continuous cleaning process is obtained. FIG. 5 schematically illustrates such an apparatus.

The apparatus 16 is mounted on a frame 18 having wheels 20 journalled thereon for movement over the surface to be cleaned. The movement of the portable unit can be effected by towing as shown in FIG. 1 or the unit can be motorized as a self-powered unit. A storage bin 22 holds a supply of particulate material which is fed gravitationally downwardly from an outlet 24 at the bottom into a funnel 26 which channels the particles into the central cage of an airless centrifugal blasting wheel 28 which is rotated at high speed as by means of a motor 30. The particles are thrown in a pattern with high centrifugal force from the periphery of the wheel onto the underlying surface 12.

Centrifugal blasting wheels of the type illustrated are well known to the trade and are marketed under the name "Wheelabrator" by Wheelabrator-Frye, Inc. of Mishawaka, Ind. The present method does not rely on the use of such an airless centrifugal blasting wheel for projecting the particles onto the surface since other well known means for projecting particles at high speed can be used, such as an air blast, vapor blast and the like, using suitably located nozzles disposed on a portable apparatus.

In order to confine dust, dirt and the particulate material in a manner to prevent contamination of the atmosphere and to protect personnel from injury from the particles, the blast area is preferably enclosed within a guard housing 34 which terminates a short distance above the surface 12 and is open at the bottom so as to expose the surface to the particulate material projected from the wheel. The wheel 28 is mounted in the upper portion of the housing in spaced relation above the surface and adjusted to throw the particles 17 in a pattern to engage the surface rearwardly of the wheel preferably at a slight angle with reference to the direction of movement of the portable unit. After the material has been thrown onto the surface, it may be recovered for reuse by a variety of means indicated by the box 36 on the rear portion of the apparatus. The recovery means may comprise a magnetic rotating drum as described in my copending application Ser. No. 432,353, now U.S. Pat. No. 3,858,359 to which reference is made and incorporated hereby; by vacuum means, as disclosed in copending application Ser. No. 363,723 of Clyde A. Snyder, assigned to the assignee of the present invention, or by conventional means such as brushes, rebound techniques or manual sweeping.

Figure 5:
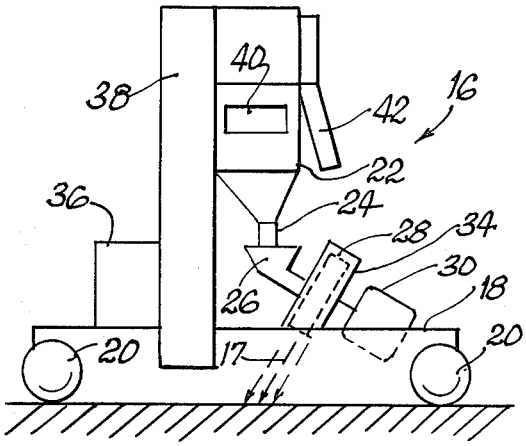
FIG. 5 is an apparatus capable of performing the method of the present invention.

In the apparatus illustrated in FIG. 5, it will be presumed, for the purposes of explaining the present invention, that the recovery means 36 is either a magnetic or vacuum recovery means, or a combination of both magnetic and vacuum recovery means. The latter system is preferred. It will pick up ferromagnetic (steel) shot or grit by the magnetic means and recycle it through a belt and bucket conveyor 38 to the particulate storage 22 via filtering means 40 for reuse. The vacuum recovery means is then utilized primarily to pick up the dislodged rubber and petroleum deposits 14 and any small amount of particulate not attracted to the magnetic means. As is disclosed in the copending applications referenced above, both the vacuum and magnetic recovery devices preferably employ air jets positioned rearwardly of the device to aid in the recovery of the particulate material.

Assuming the use of an apparatus as illustrated in FIG. 5 to practice the cleaning technique according to the present invention, the following sequence is employed: The device is loaded with particulate material, preferably steel shot or steel grit of an appropriate size depending upon the type of runway surface to be treated and the operational parameters of the machine. If, for example, a Wheelabrator airless centrifugal blasting wheel is employed as the projecting means, flow rates in the range of 50 to 2,300 lbs. of particulate per minute can be used with a preferred range, for cleaning, of 400 to 600 lbs. per minute. For this range of flow rates and for a typical highway or runway projection velocities in the range of 100 to 700 feet/sec. can be used with a preferred range of 160 to 420 feet/sec.

Combining this information with the details of the composition of the surface to be cleaned, it is possible to select the appropriate particulate type and size to effect deposit removal. The portable device is then caused to travel over the deposit laden runway surface as illustrated in FIG. 1 projecting the particulate onto the surface for removing the deposits in the manner illustrated in FIG. 4. Depending on the thickness of the deposits, the type of surface to be cleaned and the machine parameters, a satisfactory travel speed for the machine is determined. A typical range for the device of FIG. 5 is 10 to 500 feet per minute.

As the particulate 17 strikes the deposits 14 its kinetic energy is sufficient to penetrate through the deposits onto the underlying surface 12 and thereby to interfere with the bond between the deposit and the surface. Further, the action of the particulate in penetrating or debonding the deposits tends to fragment the deposits by exceeding its self-bonding energy.

After particulate projection onto the runway, the recovery portion of the apparatus passes over the area blasted for the purpose of recovering the spent particulate and for picking up the removed deposits. As previously mentioned, if a combination of magnetic and vacuum recovery means are employed, the particulate may be readily picked up, filtered and recycled for further blasting while the nonmagnetic deposits are drawn in by the suction means and collected in a waste hopper 42. The collected waste is suitable for use as fillers in asphalt paving mixes, concrete mixes and the like, and thus as a practical matter they help offset the cost of cleaning runway surfaces.

As an example only of the effectiveness of the above described technique, it has been found that a dirty runway, i.e., one coated with oil and rubber deposits, has a coefficient of friction less than 0.4 when wet where zero represents no friction and 1.0 represents no slippage between two surfaces, i.e., runway and a tire. A typical runway operates in the range of 0.4 to 0.8. After cleaning, according to the present invention, the coefficient of friction on a concrete runway is between 0.60 and 0.68.

Figure 6:
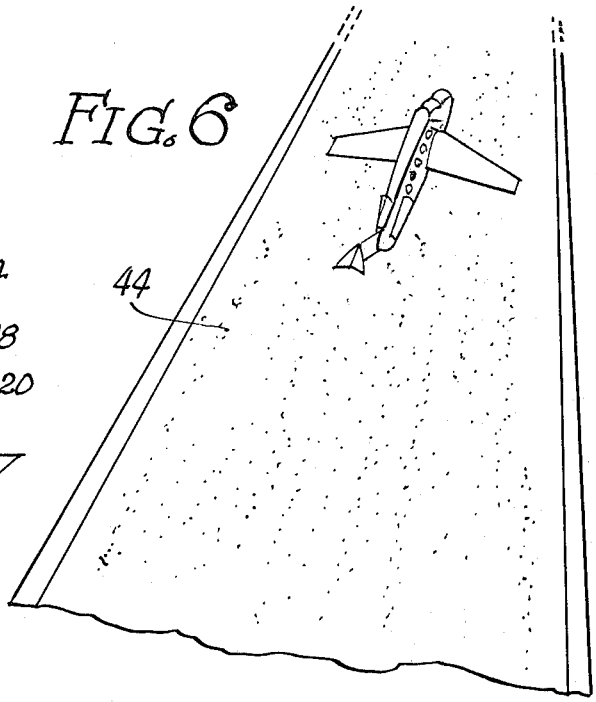
FIG. 6 is a perspective view of a smooth runway which requires texturing.

Referring now to FIG. 6, an alternate application of the method of the present invention is disclosed. The figure shows an airport runway 44 which is smooth and clean. This condition occurs when a new runway is constructed prior to its being grooved or where no attempt has been made to roughen the surface during paving. Since airport runways must have a specified minimum coefficient of friction (about 0.4), to permit aircraft to safely take off and land, it is necessary that a new runway or a recently cleaned runway surface be textured in some manner to provide the required surface roughness. This roughness provides a coefficient of friction adequate to assure good traction between the rubber tires of an aircraft landing gear and the runway surface. On heavily used runways, this roughness degenerates from the repeated frictional contact of the tires. Further, chemical treatments for ice removal and/or cleaning further degenerate the desired surface texture of a runway.

Figure 7:
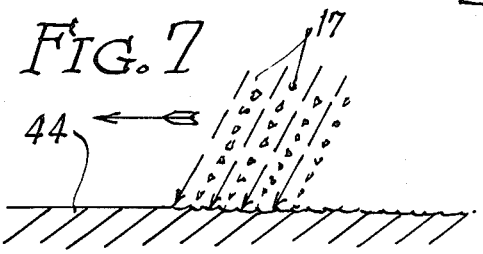
FIG. 7 is a cross-sectional view illustrating how the method of the present invention is effective to texture a smooth runway surface.

According to a first alternate technique illustrated in FIG. 7, the portable blasting equipment shown in FIG. 5 may be used to texture a new surface or to re-texture a cleaned surface. The texturing produces a desired coefficient of friction by the selective use of various sizes of particulate material such as shot or preferably grit because of its superior cutting ability. As in the case of cleaning deposits from the surface, the particulate 17 is projected at velocities selected to provide it with a minimum required value of kinetic energy. In this case, however, the kinetic energy required is that necessary to exceed the bonding strength of the runway surface 44. Thus, when the particulate material is projected onto the surface to be textured, the material penetrates the smooth surface of the runway producing pitting, exposing the paving stone by removing the cement.

The amount of texturing produced, as in the case of cleaning, is determined by the size of the shot or grit, the velocity with which it is projected onto the surface, and the speed at which the portable device travels. Where the grit is recovered by magnetic, vacuum or other means and recycled, continuous texturing can be effected as the portable apparatus moves down the runway.

As an example only, it has been found that round steel shot of approximately 0.055 inches to 0.033 inches in diameter or steel grit of the same approximate size will provide a roughened texture on concrete and asphalt surfaces when projected at velocities of approximately 230 to 360 feet per second with the apparatus traveling at up to 100 ft./min.

Figure 8:
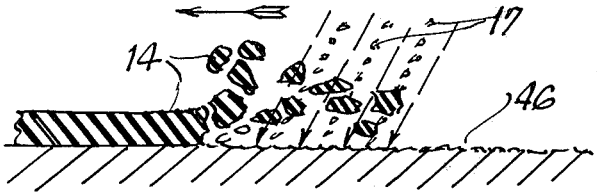
FIG. 8 is a view similar to FIG. 7 illustrating how a modification of the method permits simultaneous deposit removal and surface texturing.

It will be apparent that it is possible to combine the cleaning technique and the texturing technique. That is, where a used runway is to have the hydrocarbon and rubber deposits removed therefrom and then be re-textured, it is possible to accomplish both objectives in a single operation. This alternative technique is illustrated in FIG. 8. In such an operation it is necessary to impart kinetic energy to the particulate material 17 greater than would be required for simply removing deposits from the surface 46. In addition to breaking up the deposits it is desired to project the particulate material with sufficient energy to also texture the surface concurrently with removing the deposits therefrom. This can be accomplished by increasing the projection velocity and/or size of the particulate or by slowing down the rate of travel of the blasting apparatus. By exposing the surface to be treated for a longer period to more energetic particulate the deposits are quickly removed and the cleaned surface textured by the continuing blast.

Figure 9:
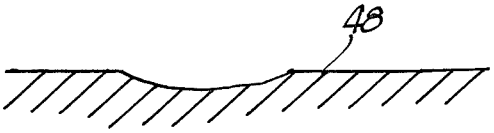
FIG. 9 is a cross-sectional view of a worn runway in need of repaving.
Figure 9A:
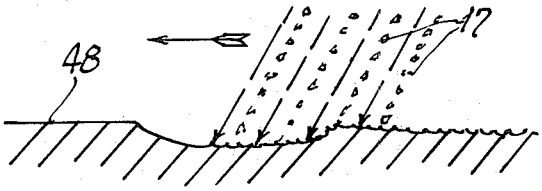
FIG. 9A illustrates the technique for texturing the runway of FIG. 9 to increase the bond strength between the existing surface and the new pavement.

Referring now to FIGS. 9 and 9A, a further application of the present method is disclosed. Where a highway or runway 48 has been subjected to particularly severe use, the surface will be damaged, having cracks, potholes and the like, as shown in FIG. 9. In such cases, in order to restore the integrity and safety of the surface for vehicular travel, it is necessary to repave or resurface. The resurfacing is often done with asphalt or concrete mixes. The degree of bonding strength between the original surface and the resurfacing material is enhanced by roughening the original surface prior to repaving. As will be apparent, the present method of blasting particulate onto a surface at kinetic energies greater than the bonding energy of the surface can be utilized to texture the damaged runway prior to resurfacing. The texturing, as indicated in FIG. 9A, will cause pitting in the area to be resurfaced, thereby roughening it. After particulate recovery in the manner previously described, resurfacing may be accomplished with high bonding strength between the new surface and the old.

Figure 10:
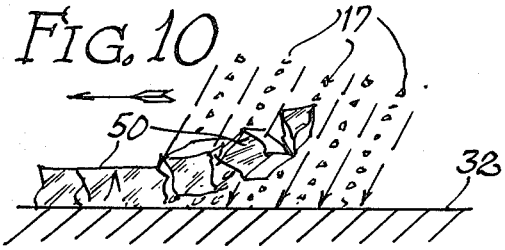
FIG. 10 is a cross-sectional view of a modification of the present invention for removing ice from a surface.

Referring now to FIG. 10, a still further application of the method according to the present invention is disclosed. Utilizing the present method, it is possible to remove ice from vehicular surfaces where other means of ice removal are not possible or are undesirable. For example, the presence of ice on aircraft runways is very dangerous to the aircraft during landing and takeoff as well as during taxiing to and from departure gates. Similarly, automobile safety is increased by removal of ice from highways. In the case of automobile traffic, salt can be used to melt the ice or abrasive material such as sand or cinders can be put down to increase the friction on the surface. Such methods, although corrosive and abrasive to automobiles, are nevertheless tolerated. In the case of aircraft, such techniques are expressly forbidden because of the effect the salt and abrasives have on aircraft components.

It is possible to utilize a particulate blast projected onto ice formed on a runway or highway with sufficient kinetic energy to fragment the ice into small particles 50 for removal. The required kinetic or impact energy will depend on the physical characteristics of the ice as thickness and on the ambient temperature.

The particulate and ice can be selectively picked up in the manner previously discussed for continuous removal. An additional problem presented in this embodiment, however, is that the particulate becomes wet during the process of fragmenting the ice. In order for it to be reused, it must be dried somewhat and thus when the particulate is picked up it is de-watered by centrifugal means, by heating, or by evaporation.

While in each of the embodiments of the present invention the technique has been described as employing a Wheelabrator airless blasting wheel, it should again be remembered that the method can be practiced by any type of blasting device such as pressure nozzles, gas nozzles and the like which have the capability of projecting particulate material onto a vehicular surface with kinetic energy sufficient to interfere with the bonding strength of the deposits and/or the surface depending on the purpose at hand.

While I have shown and described embodiments of this invention in some detail, it will be understood that this description and illustrations are offered merely by way of example, and that the invention is to be limited in scope only by the appended claims.

I claim:

1. A method for removing ice from a surface comprising the steps of:

a. selecting a particulate material according to the physical characteristics of the ice to be removed;

b. Projecting the selected material onto the ice with kinetic energy sufficient to fragment the ice;

c. recovering the particulate material;

d. removing the ice fragments from the surface; and e. removing contaminants from the particulate material.

2. The method according to claim 1 wherein the step of selecting the particulate includes the substeps of:

determining the ambient temperature and the thickness of the ice to be fragmented; and selecting the composition, density and diameter of the particulate material required to fragment ice.

3. The method according to claim 1 wherein the step of projecting the material onto the surface includes the substep of:

varying the kinetic energy to compensate for varying ice conditions.

4. A method for removing ice from a surface comprising the steps of:

a. selecting a particulate material according to the physical characteristics of the ice to be removed;

b. projecting the selected material onto the ice with kinetic energy sufficient to fragment the ice;

c. recovering the particulate material including the substeps of: screening the material to remove contaminants; removing water from the recovered particulate; reusing the particulate material for further ice removal;

d. removing the ice fragments from the surface.

5. The method of claim 1 including removing the water from the recovered particulate material by centrifugal action.

6. The method of claim 4 including removing the water from the recovered particulate material by heating.

* * * * *